United States Patent [19]

Sato et al.

[11] 3,982,948

[45] Sept. 28, 1976

[54] PROCESS FOR PREPARING SILVER HALIDE EMULSION CONTAINING A RHODIUM SALT AND A DECOMPOSITION PRODUCT OF NUCLEIC ACID

[75] Inventors: Haruhiko Sato; Hidehiko Ishikawa; Katsuo Mogaki, all of Odawara, Japan

[73] Assignee: Konishiroku Photo Co. Ltd., Japan

[22] Filed: June 24, 1974

[21] Appl. No.: 481,982

[30] Foreign Application Priority Data

July 2, 1973 Japan ..... 48-73607

[52] U.S. Cl. ..... 96/109; 96/94 R

[51] Int. Cl.² ..... G03C 1/34

[58] Field of Search ..... 96/108, 109, 110, 94 R, 96/95

[56] References Cited

UNITED STATES PATENTS

| | | | |
|---|---|---|---|
| 3,512,982 | 5/1970 | Taber et al. | 96/109 |
| 3,531,289 | 9/1970 | Wood | 96/108 |

OTHER PUBLICATIONS

Hackh's, "Chemical Dictionary," 4th Edition, McGraw-Hill, Nov., 1969, p. 465.

*Primary Examiner*—Won H. Louie, Jr.
*Attorney, Agent, or Firm*—Bierman & Bierman

[57] ABSTRACT

A process for the preparation of silver halide photographic emulsions, characterized in that a water-soluble rhodium salt and an effective stabilizing amount of a compound taken from the class consisting of adenine, guanine, uracil, cytosine and thymine is added to a silver halide photographic emulsion prior to completion of the physical ripening thereof.

6 Claims, No Drawings

PROCESS FOR PREPARING SILVER HALIDE EMULSION CONTAINING A RHODIUM SALT AND A DECOMPOSITION PRODUCT OF NUCLEIC ACID

This invention relates to a process for the preparation of silver halide photographic emulsions. More particularly, the invention relates to a process for the preparation of silver halide photographic emulsions having desired high contrast characteristics and being stable against fog.

A silver halide emulsion is generally prepared by subjecting a disparsion of a hydrophilic colloid and silver halide which is prepared by an amoniac method, neutral method, conversion method simultaneously mixing method or the like to a first ripening (physical ripening) and subjecting the so formed emulsion to a second repening (chemical repening).

It is known in the art that in order to impart high contrast characteristics to silver halide photographic emulsions a water-soluble rhodium salt is added prior to completion of the first ripening (physical ripening) of silver halide photographic emulsions. Silver halide photographic emulsions to which high contrast photographic characteristics have been imparted according to this method, however, are very poor in stability. For instance, the high contrast characteristics are drastically degraded during storage, and the sensitivity changes greatly with the lapse of time. Further, these silver halide photographic emulsions are defective in that fog is readily caused, especially during storage.

As typical means for overcoming these defects, there is known a method in which a cadmium salt is added during the process steps of preparing water-soluble rhodium salt-containing silver halide photographic emulsions. In view of improvement of photographic characteristics of silver halide photographic emulsions, addition of a cadmium salt is very desirable. For instance, addition of a cadmium salt results in effects of narrowing the particle size distribution, imparting good contrast characteristics to photographic emulsions and improving the stability against fog. However, because of noxiousness of cadmium salts it is not preferred to employ them in effective amounts, and therefore, the method using a cadmium salt is undesirable.

It is therefore a primary object of this invention to provide a process for the preparation of silver halide photographic emulsions, according to which desired contrast characteristics can be imparted to silver halide photographic emulsions and it is possible to prepare silver halide photographic emulsions which have photographic characteristics very stable at storage, especially stable contrast characteristics and durable stability against fog and which are quite harmless.

In accordance with this invention, the above object is performed by a process for the preparation of silver halide photographic emulsions, characterized in that a water-soluble rhodium salt and a decomposition product of nucleic acid are added to a silver halide photographic emulsion prior to the completion of a first ripening of the silver halide emulsion.

Any of water-soluble rhodium salts heretofore used in this field can be used in this invention. Typical instances of the water-soluble rhodium salt include a rhodium monochloride, rhodium chloride, rhodium trichloride, rhodium ammonium chloride, and the like. Typical instances of the decomposition product of nucleic acid that can be used in this invention include an adenine, guanine, uracil, cytosine, thymine and the like.

These water-soluble rhodium salt and nucleic acid decomposition product are generally added to a silver halide photographic emulsion in the form of a solution, for example, an aqueous solution. It is indispensable that they should be added prior to the completion of the first ripening preferably at the step of emulsification and/or during the first repening. The water-soluble rhodium salt and the nucleic acid decomposition product can be added simultaneously or separately. It is possible to add them separately at different stages, for example, one at the step of emulsification and the other during the first ripening. However, when they are added at other stages, for example at the step of the second ripening (chemical ripening), no synergistic effect can be attained by the specific combination of the water-soluble rhodium salt and nucleic acid decomposition product.

Amounts added of the water-soluble rhodium salt and nucleic acid decomposition product vary depending on the kinds of the compounds used, their combination, the kind of the silver halide and other factors, but good results are generally obtained when the water-soluble rhodium salt is used in an amount of 0.005 to 0.20 mg per mole of the silver halide and the nucleic acid decomposition product is used in an amount of at least about 20 mg, especially 50 to 150 mg, per mole of the silver halide.

Ordinary silver halide photographic emulsions are generally formed by dispersing silver halide particles into gelatin, and it is known that nucleic acid and its decomposition products are originally present in this gelatin binder. However, such naturally occurring amounts are not effective for attaining the intended object of this invention. In other words, in this invention, decomposition products of nucleic acid are incorporated into a silver halide photographic emulsion and are added to such naturally occurring decomposition products. As a result of our research works, it has been confirmed that the presence of nucleic acid is not preferred for attaining the object of this invention.

In case a water-soluble rhodium salt and a decomposition product of nucleic acid are added to a silver halide photographic emulsion prior to the completion of the first ripening according to this invention, the intended object of this invention can be attained by the synergistic effect of the water-soluble rhodium salt and nucleic acid decomposition product, and a silver halide photographic emulsion excellent in the graininess, the high contrast characteristics, the storage stability and other properties. Further, according to the process of this invention, a silver halide photographic emulsion having excellent properties can be obtained without employing a cadmium salt, and silver halide photographic emulsions prepared by the process of this invention have photographic properties at least comparable or superior to those of silver halide photographic emulsions prepared by employing an effective amount of a cadmium salt in combination with a water-soluble rhodium salt according to the known process.

The silver halide photographic emulsion prepared according to this invention can be applied to various uses. For instance, they can be used for black-and-white photography, color photography, pseudo-color photography and the like, and they can be applied to formation of films, printing papers and other photographic materials. More specifically, the silver halide photographic emulsion prepared by the process of this invention can be used broadly for formation of various photosensitive materials for ordinary black-and-white photography, black-and-white printing, X-ray photography, electrophotography, high resolving power black-and-white photography, ordinary color photography, color X-ray photography, diffusion transfer type color photography, and the like.

A silver halide photographic emulsion generally comprises a hydrophilic collorid and silver halide particles dispersed therein. As the silver halide, there can be used silver chloride, silver bromide, silver iodide and mixed silver halides such as silver chlorobromide, silver iodobromide and silver chloroiodorbromide. These silver halides are prepared by the ammonia method, the neutral method, the so called conversion method, the simultaneous mixing method and the like. The particle size of the silver halide, the amount of the silver halide incorporated into an emulsion and the mixing ration of halides in the mixed silver halide are determined depending on the intended use of the final photosensitive material. In the case of a silver halide of a relatively low sensitivity and a fine particle size, silver chloride is a main component, and in the case of a silver halide of a relatively high sensitivity, the content of silver chloride is low.

When the silver halide is of the direct reversal type, it is optically or chemically fogged in advance (prior to coating on a support).

Gelatin is generally used as a medium or binder in which the silver halide is dispersed. All or a part of gelatin can be substituted by colloidal albumin, a cellulose derivative or a synthetic resin such as a polyvinyl compound.

The silver halide photographic emulsion of this invention, which has been subjected to the first ripening, is then forwarded to precipitation, water-washing and second ripening steps, where it is treated according to conventional methods. At these steps, various photographic additives can be added to the silver halide photographic emulsion of this invention.

For example, there can be used sulfur sensitizers such as allylthiocarbamide, thiourea and cystine, selenium, sensitizers, and noble metal sensitizers such as gold sensitizers, e.g., potassium chloroaurite, potassium auriothiocyanate, potassium chloroaurate and 2-aurosulfobenzothiazole methochloride and sensitizing agents of salts of noble metals such as ruthenium, rhodium, palladium and iridium, e.g., ammonium chloropalladate, potassium chloroplatinate and sodium chloropalladite (it is known that some of noble metal sensitizers, such as platinum salts, act as sensitizing agents or fog-preventive agents depending on the amounts used). These chemical sensitizers can be used singly or in combination. In addition, it is possible to employ other various photographic additives, for example, optical sensitizers such as cyanine dyes and merocyanine dyes; stabilizers or anti-foggants such as triazoles, azaindenes, quaternary benzthiazolium compounds and zinc compounds; sensitizing compounds such as alkylene oxides; gelatin plasticizers such as glycerin, I, 5-pentanediol, other hydroxyalkanes, esters of ethylene-bis-glycolic acid, bis-ethoxydiethyleneglycol succinate, acrylic acid amides and latices; film-hardening agents such as formaldehyde, halogen-substituted fatty acids, e.g., mucobromic acid, acid anhydride group-containing compounds, dicarboxylic acid chlorides, diesters of methanesulfonic acid and sodium bisulfite derivatives of dialdehydes in which the two aldehyde groups are separated from each other by 2 or 3 carbon atoms; coating agents such as saponin; coating assistants such as sulfosuccinic acid salts; so called covering power-improving agents; ultraviolet absorbers; fluorescent whitening agents; and the like.

In case the silver halide photographic emulsion of this invention is used for a photosensitive material for color photography, it is desired that there is established a certain relationship between the absorption wavelength region of a dye formed from a coupler used in combination with the silver halide photographic emulsion and the optically sensitized wavelength region of the emulsion, and in general, a complementary relationship is established between said wavelength regions. It is possible to incorporate such coupler into the silver halide photographic emulsion. Typical instances of such coupler include magenta couplers of the 5-pyrazolone type, cyan couplers of the naphthol or phenol type, and yellow couplers containing an active methylene group interposed between two carbonyl groups. These couplers may be either so called two-equivalent couplers or four-equivalent couplers. These couplers can be used singly or in combination with so called masking couplers having split-off groups such as arylazo groups at active position thereof, so called D.I.R. couplers having split-off groups acting as development inhibitors, D.D.R. couplers having a diffusible dye as the split-off group, white couplers forming a dye having no substantial color, and the like.

Incorporation of such couplers into silver halide photographic emulsions can be accomplished according to customary dispersing methods such as so called Fischer dispersion method and protect-dispersion method.

In case the silver halide photographic emulsion is applied to a certain kind of a photosensitive material for color photography, a so called dye developer having the dye moiety and the developer moiety in one molecule can be added to the emulsion. The emulsion of this type is preferably employed for formation of a photosensitive layer for the diffusion transfer method.

As mentioned above, the silver halide photographic emulsion of this invention can contain various photographic additives according to need depending on the intended use. The silver halide photographic emulsion of this invention has no bad influences on these photographic additives, and photographic properties of the emulsion of this invention are not degraded by incorporation of these additives. Accordingly, this invention can provide silver halide photographic emulsions having high practical utility.

The so formed silver halide photographic emulsion is coated on a support such as a film or sheet of paper, laminated paper, glass, cellulose acetate, cellulose nitrate, polyester, polyamide, polystyrene or the like, if desired, through an undercoat layer, an intermediate layer, a filter layer, other photosensitive layer or the like according to customary methods. Thus is provided a photographic photosensitive material.

This invention will now be detailed by reference to the following Examples.

EXAMPLE 1

According to the double-jet method, the following emulsions A, B and C of silver chlorobromide (the mole ratio of silver chloride : silver bromide being 2 : 8) were prepared.

A: Rhodium chloride was added to an aqueous solution of gelatin in an amount of 0.03 mg per mole of the silver halide, and cadmium chloride was added thereto in an amount of 1.5 g per mole of the silver halide. Then, an aqueous solution of sodium choride and potassium bromide and an aqueous solution of silver nitrate were simultaneously added to the gelatin solution. At this time, the gelatin solution was violently agitated.

B: Rhodium chloride was added to an aqueous solution of gelatin in an amount of 0.03 mg per mole of the silver halide, and adenine was further added in an amount of 80 mg per mole of the silver halide. In the same manner as mentioned above in A, an aqueous solution of sodium chloride and potassium bromide and an aqueous solution of silver nitrate were simultaneously added.

C: Rhodium chloride was added to an aqueous solution of gelatin in an amount of 0.03 mg per mole of the silver halide, and in the same manner as described above in A, an aqueous solution of sodium chloride and potassium bromide and an aqueous solution of silver nitrate were simultaneously added to the gelatin solution.

The so formed 3 emulsions were subjected to the first ripening, and water-soluble salts were removed according to customary procedures. Then, each emulsion was subjected to the second repening and incorporated with a stabilizer, a film-hardening agent and the like. Then, each emulsion was coated on baryta paper. Each of the resulting sample was subjected to the stepped wedge exposure and treated with a liquid developer of the D-72 type (liquid developer recipe of Eastman Kodak Co.) to obtain results shown below. This test was conducted on both the sample just agter the emulsion coating step and the sample which had been allowed to stand still at 55°C. for 3 days.

In the following table, the relative sensitivity of each of samples A, B and C is a relative value of the sensitivity after the standing calculated based on the sensitivity just after the coating step, which is defined as 100.

Table

| Sample | Just After Coating Contrast | Just After Coating Fog | After Standing Contrast | After Standing Fog | Relative Sensitivity |
|---|---|---|---|---|---|
| A | 3.30 | 0.05 | 3.18 | 0.07 | 108 |
| B | 3.26 | 0.05 | 3.12 | 0.07 | 110 |
| C | 3.10 | 0.08 | 2.56 | 0.23 | 134 |

As is apparent from the above results, in the case of the sample free of either cadmium or adenine, when it was allowed to stand still the contrast was greatly reduced, the sensitivity was highly elevated and increase of fog was conspicuous. In contrast, the samples A and B incorporated with cadmium chloride or adenine had excellent photographic properties. The amount of cadmium chloride incorporated into the sample A was a harmfull amount.

EXAMPLE 2

Emulsions A, B and C were prepared in the same manner as in Example 1, and after the second ripening, each emulsion was incorporated with a stabilizer, a film-hardening agent and the like and further incorporated with a red-sensitive sensitizing dye, a cyan coupler and the like. Each emulsion was coated on polyethylene-coated paper and dried to form a photographic photosensitive material.

Each sample was exposed to the stepped exposure according to customary procudues and subjected to ordinary coloring development. This test was conducted on both the sample just after the coating step and the sample which had been allowed to stand still at 55°C. for 3 days. The obtained results are shown in the following table.

In the table, the value of the relative sensitivity is one calculated in the same manner as in Example 1.

Table

| Sample | Additives: rhodium chloride | Additives: cadmium chloride | Additives: adenine | Just After Coating Contrast | Just After Coating Fog | After Standing Contrast | After Standing Fog | Relative Sensitivity |
|---|---|---|---|---|---|---|---|---|
| A | added | added | not added | 3.80 | 0.03 | 3.67 | 0.05 | 114 |
| B | added | not added | added | 3.74 | 0.03 | 3.54 | 0.06 | 118 |
| C | added | not added | not added | 3.42 | 0.06 | 2.82 | 0.24 | 135 |

It is apparent that results similar to those obtained in Example 1 were obtained when the silver halide photographic emulsions of Example 1 were used for formation of photosensitive materials for the coupler-in-emulsion type color photography.

EXAMPLE 3

The following three emulsions D, E and F of silver chlorobromide (the mole ratio of silver chloride : silver bromide being 7 : 3) were prepared.

An aqueous solution of sodium chloride and potassium bromide and an aqueous solution of silver nitrate were added simultaneously to an aqueous solution of gelatin at 55°C. under violent agitation. At this step, rhodium ammonium chloride was added to the emulsion in an amount of 0.015 mg per mole of the silver halide, and then, the emulsion was incorporated with cadmium chloride in an amount of 2.0 g per mole of the silver halide (emulsion D) or guanine in an amount of 120 mg per mole of the silver halide (emulsion E). In the case of the emulsion F, neither cadmium chloride nor guanin was added. Then, each emulsion was subjected to the first ripening, and in the same manner as in Example 1, watersoluble salts were removed according to customary procedures and the second ripening was conducted. Then, each emulsion was incorporated with a stabilizer, a film-hardening agent and the like, and it was coated on an undercoated polyester film and dried.

Each of the so obtained samples was subjected to the stepped wedge exposure according to customary procedures and developed with a liquid developer of the D-II or D-85 type (each being the recipe of Eastman Kodak Co.). The test was conducted on both the sample just after the coating step and the sample which had been allowed to stand still at 55°C. for 3 days. The obtained results are shown in the following table. In the table, the value of the relative sensitivity is one calculated as in Example 1.

Table

| | D-II | | | | | D-85 | | | | |
|---|---|---|---|---|---|---|---|---|---|---|
| | Just After Coating | | After Standing | | | Just After Coating | | After Standing | | |
| Sample | Contrast | Fog | Contrast | Fog | Relative Sensitivity | Contrast | Fog | Contrast | Fog | Relative Sensitivity |
| D | 4.2 | 0.12 | 3.9 | 0.16 | 105 | 5.8 | 0.02 | 6.1 | 0.02 | 95 |
| E | 4.0 | 0.10 | 3.8 | 0.16 | 107 | 5.4 | 0.02 | 5.8 | 0.02 | 92 |
| F | 3.6 | 0.16 | 3.0 | 0.28 | 120 | 4.8 | 0.02 | 4.4 | 0.02 | 100 |

From the above results, it is apparent that the sample of this invention had excellent photographic properties as the sample of this invention prepared in Example 1.

What is claimed is:

1. A process for the preparation of silver halide photographic emulsions, characterized in that a water-soluble rhodium salt and an effective stabilizing amount of at least 20 mg per mole of silver halide of a compound taken from the class consisting of adenine, guanine, uracil, cytosine and thymine is added to a silver halide photographic emulsion prior to completion of the physical ripening thereof.

2. A process for the preparation of silver halide photographic emulsions according to claim 1 wherein said water-soluble rhodium salt and said compound are added to a silver halide photographic emulsion in an emulsifying step prior to said physical ripening thereof.

3. A process for the preparation of silver halide photographic emulsions according to claim 1, wherein said rhodium salt and said compound are added to a silver halide photographic emulsion in said physical ripening.

4. A process for the preparation of silver halide photographic emulsions according to claim 1 wherein one of said rhodium salt and said compound is added in an emulsifying step prior to said physical ripening and the other is added during said physical ripening to a silver halide emulsion.

5. The process of claim 1 wherein said water-soluble rhodium salt is present in the amount between about 0.005 and 0.20 mg per mole of silver halide.

6. The process of claim 5 wherein said amount is between about 50 and 150 mg per mole of silver halide.

* * * * *